US009391371B2

(12) United States Patent
Goto et al.

(10) Patent No.: US 9,391,371 B2
(45) Date of Patent: Jul. 12, 2016

(54) ANTENNA DEVICE AND WIRELESS COMMUNICATION DEVICE USING THE SAME

(71) Applicants: TDK Corporation, Tokyo (JP); TDK Dalian Corporation, Liaoning (CN)

(72) Inventors: Tetsuzo Goto, Tokyo (JP); Naoaki Utagawa, Tokyo (JP); Yongshuai Zheng, Liaoning (CN)

(73) Assignee: TDK CORPORATION, Tokyo (JP)

( * ) Notice: Subject to any disclaimer, the term of this patent is extended or adjusted under 35 U.S.C. 154(b) by 114 days.

(21) Appl. No.: 14/445,792

(22) Filed: Jul. 29, 2014

(65) Prior Publication Data

US 2015/0035713 A1 Feb. 5, 2015

(30) Foreign Application Priority Data

Aug. 5, 2013 (JP) ..... 2013-162455

(51) Int. Cl.

| | |
|---|---|
| ***H01Q 9/00*** | (2006.01) |
| ***H01Q 9/42*** | (2006.01) |
| ***H01Q 5/50*** | (2015.01) |
| *H01Q 1/38* | (2006.01) |

(52) U.S. Cl.

CPC . *H01Q 9/42* (2013.01); *H01Q 5/50* (2015.01); *H01Q 1/38* (2013.01)

(58) Field of Classification Search

CPC ..... H01Q 9/0407; H01Q 5/50; H01Q 9/42; H01Q 1/38

USPC ..... 343/745, 749, 750, 700 MS

See application file for complete search history.

(56) References Cited

U.S. PATENT DOCUMENTS

| | | | | |
|---|---|---|---|---|
| 5,969,680 | A * | 10/1999 | Tsuru | H01Q 9/0421 343/700 MS |
| 8,212,731 | B2 * | 7/2012 | Bungo | H01Q 1/243 343/700 MS |
| 8,279,121 | B2 * | 10/2012 | Ishizuka | H01Q 1/243 343/700 MS |
| 2010/0103057 | A1 * | 4/2010 | Harihara | H01Q 1/243 343/702 |
| 2011/0102268 | A1 | 5/2011 | Watanabe et al. | |
| 2013/0088398 | A1 * | 4/2013 | Utagawa | H01Q 1/38 343/745 |

FOREIGN PATENT DOCUMENTS

| | | |
|---|---|---|
| JP | 2008-252506 | 10/2008 |
| JP | 4973700 | 2/2011 |

* cited by examiner

*Primary Examiner* — Dameon E Levi
*Assistant Examiner* — Hasan Islam
(74) *Attorney, Agent, or Firm* — Young Law Firm, P.C.

(57) ABSTRACT

An antenna device 1 has a capacitive coupling element 10 mounted on a printed circuit board 20. Strip patterns 21 to 23 are provided in a grand clearance region 20A defined on one principal surface of the printed circuit board 20. The strip pattern 21 is connected to a feeding line 29 after extending in a first direction from the connecting point with the capacitive coupling element 10. The strip pattern 22 is connected to a feeding line 30 after extending in a second direction, that is an opposite to the first direction, from the connecting point. The strip pattern 23 is connected to a ground pattern 24 after extending in a third direction from the connecting point. The capacitive coupling element 10 is disposed with an offset toward the first direction. The strip pattern 21 is shorter in length than the strip pattern 22.

7 Claims, 11 Drawing Sheets

SYMMETRIC

2mm OFFSET

4mm OFFSET

ANTENNA DEVICE AND WIRELESS COMMUNICATION DEVICE USING THE SAME

BACKGROUND OF THE INVENTION

1. Field of the Invention

The present invention relates to an antenna device and a wireless communication device using the antenna device, and particularly to the structure of a dual-band antenna.

2. Description of Related Art

Smartphones and other portable wireless terminals have a basic communication function that is used for connection to a communication line, and various other communication functions, such as GPS, Wi-Fi, Bluetooth, and NFC. In order to efficiently put those communication functions in a limited space, the use of a dual-band antenna is effective. It is known that, if two feeding points of the dual-band antenna are disposed close to each other, mutual interference occurs, leading to a deterioration of antenna characteristics. Therefore, in the case of the dual-band antenna, it is necessary to prevent the deterioration of antenna characteristics associated with the mutual interference. For example, in the antennas disclosed in Japanese Patent Application Laid-Open No. 2008-252506 and Japanese Patent No. 4,973,700, a secondary resonance mode is used to solve the above problem.

However, the problem is that a conventional antenna that makes use of a secondary resonance mode is larger in size than an antenna that only uses a primary resonance mode. It is possible to reduce the size of the antenna by adopting a folded pattern for a radiation pattern formed on a surface of a dielectric block to secure the length of the pattern. However, such a configuration leads to a deterioration of antenna radiation characteristics. Therefore, it is hoped that an improvement will be made by other methods.

SUMMARY

An object of the present invention therefore is to provide an antenna device that suppresses mutual interference between two antennas to ensure desired characteristics of each antenna.

Another object of the present invention is to provide a wireless communication device that uses the antenna device.

To solve the above problem, an antenna device of the present invention includes: a printed circuit board; and a capacitance coupling element mounted on the printed circuit board, wherein the capacitance coupling element includes: a substrate that is made of dielectric material; and first and second capacitors that are provided in the substrate, the printed circuit board includes: a ground clearance region that is defined on one principal surface of the printed circuit board, the capacitance coupling element being mounted on the ground clearance region; a main circuit region that has a ground pattern; first to third strip patterns that are provided in the ground clearance region; and first and second feeding lines that are elongated from the main circuit region to the ground clearance region, the first strip pattern has one end connected to one end terminal of the first capacitor of the capacitance coupling element and the other end connected to the first feeding line, the first strip pattern extending in a first direction from the one end thereof to the other end thereof, the second strip pattern has one end connected to one end terminal of the second capacitor of the capacitance coupling element and the other end connected to the second feeding line, the second strip pattern extending in a second direction, that is an opposite to the first direction, from the one end thereof to the other end thereof, the third strip pattern has one end connected to both the other end terminals of the first and second capacitors of the capacitance coupling element and the other end connected to the ground pattern, the third strip pattern extending in a third direction, that crosses the first and second directions, from the one end thereof to the other end thereof, the capacitance coupling element is disposed with an offset toward the first direction from a central portion of the ground clearance region in a direction parallel to the first and second directions, and the first strip pattern is shorter in length than the second strip pattern.

According to the present invention, the first strip pattern, the capacitance coupling element, and the third strip pattern work cooperatively with the ground pattern to operate as a high frequency-side antenna. The second strip pattern, the capacitance coupling element, and the third strip pattern work cooperatively with the ground pattern to operate as a low frequency-side antenna. In this manner, a dual-band antenna can be made. Furthermore, even if two antennas are provided adjacent to each other in the ground clearance region, it is possible to suppress the mutual interference between the two antennas having close resonance frequencies, and to ensure desired characteristics of each antenna. Therefore, a dual-band antenna that is small but good in isolation and which is high in radiation efficiency can be realized.

In the present invention, it is preferable that the ground clearance region has a substantially rectangular shape having first, second third and fourth edge lines, the first edge line is aligned with an edge of the printed circuit board, the second and third edge lines are substantially perpendicular to the first edge line and parallel to each other, the fourth edge line is parallel to the first edge line, the second and third edge lines are located in the first and second directions, respectively, as viewed from the capacitance coupling element, the first feeding line is elongated from the second edge line to the ground clearance region, and the second feeding line is elongated from the third edge line to the ground clearance region. In this case, it is more preferable that a distance between the capacitance coupling element and the first edge line is shorter than a distance between the capacitance coupling element and the fourth edge line, and a distance between the first and second strip patterns and the first edge line is shorter than a distance between the first and second strip patterns and the fourth edge line. This configuration improves the characteristics of the antennas by suppressing, as much as possible, the influence of circuits or components provided in the main circuit region of the printed circuit board.

In the present embodiment, it is preferable that the other end of the first strip pattern is connected to the first feeding line via a first frequency adjustment element, and the other end of the second strip pattern is connected to the second feeding line via a second frequency adjustment element. This configuration enables more accurate adjustment of the resonance frequency of each of the high frequency-side and low frequency-side antennas.

In the present invention, it is preferable that the capacitance coupling element further includes a third capacitor having one end terminal connected to the one end terminal of the first capacitor and the other end terminal connected to the one end terminal of the second capacitor. This configuration enables more accurate adjustment of impedance matching of the high frequency-side and low frequency-side antennas, and thereby suppresses the mutual interference between the two antennas.

In the present invention, it is preferable that the printed circuit board further includes fourth and fifth strip patterns that are provided on the other principal surface of the printed circuit board, the fourth strip pattern extends in the first direction and overlaps with the first strip pattern in planar view, the fifth strip pattern extends in the second direction and overlaps with the second strip pattern in planar view, the first strip pattern is connected to the fourth strip pattern via a first through-hole conductor that passes through the printed circuit board, and the second strip pattern is connected to the fifth strip pattern via a second through-hole conductor that passes through the printed circuit board. This configuration helps to further increase the apparent volumes of the first and second strip patterns, and thereby improves the radiation efficiency of the antennas.

Furthermore, a wireless communication device of the present invention includes: the antenna device of the present invention described above; a wireless circuit section that is connected to the antenna device; and a communication control section that controls the wireless circuit section, wherein the wireless circuit section and the communication control section are provided in the main circuit region of the printed circuit board. According to the present invention, it is possible to provide a small, high-performance wireless communication device having a dual-band antenna.

According to the present invention, it is possible to provide an antenna device that can suppress the mutual interference between two antennas and ensure desired characteristics of each antenna. Moreover, according to the present invention, it is possible to provide a small, high-performance wireless communication device that uses the antenna device.

BRIEF DESCRIPTION OF THE DRAWINGS

The above and other objects, features and advantages of this invention will become more apparent by reference to the following detailed description of the invention taken in conjunction with the accompanying drawings, wherein.

DETAILED DESCRIPTION OF THE EMBODIMENTS

Preferred embodiment of the present invention will be described hereinafter in detail with reference to the accompanying drawings.

Figure 1:
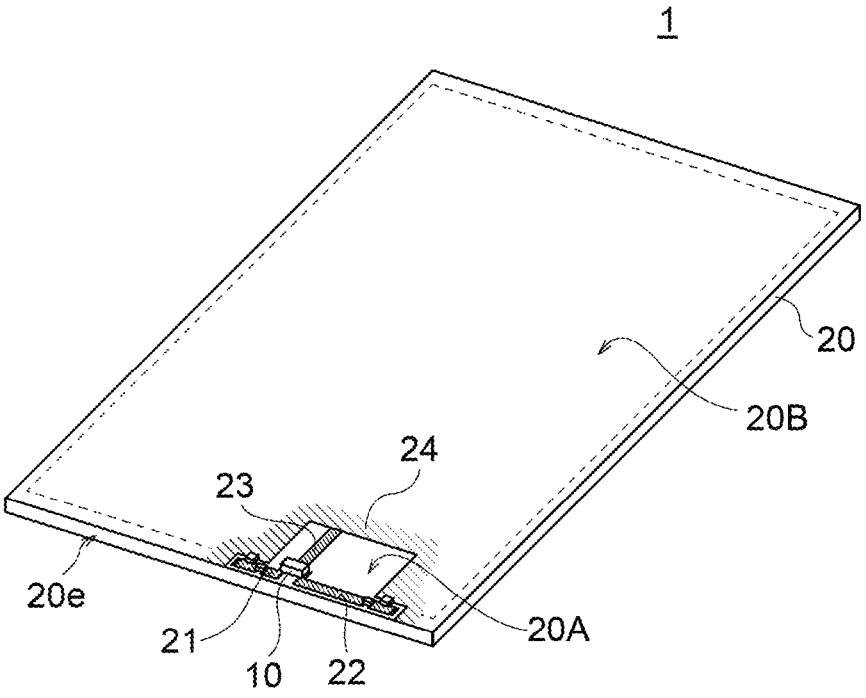
FIG. 1 is a schematic perspective view showing the configuration of an antenna device 1 according to a first embodiment of the present invention.
Figure 2:
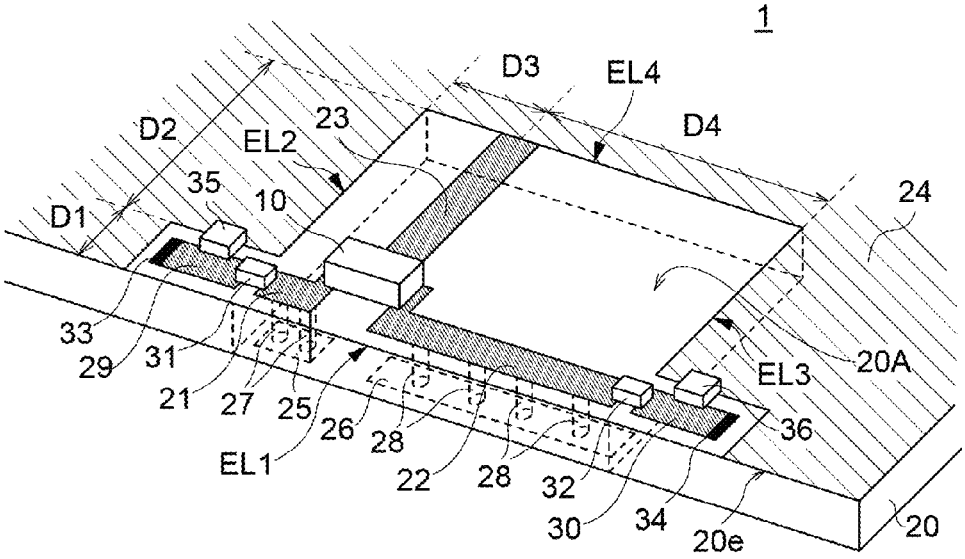
FIG. 2 is a schematic, enlarged perspective view showing the configuration of the antenna device according to the present embodiment.

FIG. 1 is a schematic perspective view showing the configuration of an antenna device 1 according to a first embodiment of the present invention. FIG. 2 is a schematic, enlarged perspective view showing the configuration of the antenna device according to the present embodiment.

As shown in FIGS. 1 and 2, the antenna device 1 of the present embodiment includes a capacitance coupling element 10, and a printed circuit board 20 on which the capacitance coupling element 10 is mounted. The capacitance coupling element 10 is mounted in a ground clearance region 20A, which is provided on one principal surface of the printed circuit board 20. The capacitance coupling element 10 is connected to first to third strip patterns 21 to 23, which are provided in the ground clearance region 20A.

From the ground clearance region 20A, any elements other than components of antennas, particularly ground patterns, are virtually eliminated. The outer periphery of the ground clearance region 20A is surrounded by an edge of the printed circuit board 20 or a ground pattern on the printed circuit board 20. In the present embodiment, the ground clearance region 20A is substantially rectangular in shape: one side of the ground clearance region 20A is in contact with an edge 20*e* of the printed circuit board 20, and the other three sides are surrounded by an edge line of a ground pattern 24 on the printed circuit board 20. More specifically, the ground clearance region 20A includes a first edge line EL1, which is aligned with the edge 20*e* of the printed circuit board 20; second and third edge lines EL2 and EL3, which are perpendicular to the first edge line EL1 and run parallel to each other; and a fourth edge line EL4, which is parallel to the first edge line EL1. In FIG. 2, the second and third edge lines EL2 and EL3 are respectively located on the left and right sides of the capacitance coupling element 10.

On the principal surface of the printed circuit board 20, an area indicated by dashed lines that is outside the ground clearance region 20A is a main circuit region 20B in which circuits or components necessary to make a wireless communication device are mounted. In the main circuit region 20B, the ground pattern 24 is provided in arbitrary location. The layout of the ground pattern varies according to how the circuits of the wireless communication device are designed. However, the ground pattern is usually formed in a wide range of the printed circuit board 20. While the details will be given later, the antenna device 1 of the present embodiment performs an antenna operation not only by using the capacitance coupling element 10, but also by using the ground pattern 24 on the printed circuit board 20 that works cooperatively with the capacitance coupling element 10.

The ground clearance region 20A is provided not only on the one principal surface of the printed circuit board 20 but also on the other principal surface. In the case of a multilayer board, the ground clearance region 20A is also provided in an inner layer. That is, right under the ground clearance region 20A that emerges on the one principal surface of the printed circuit board, a space spreads out, with any elements other than the components of antennas (particularly the ground pattern) being eliminated from the space. In this manner, the ground clearance region 20A is spatially secured. Therefore, it is possible to stabilize antenna characteristics and improve the efficiency of antenna radiation.

The capacitance coupling element 10 is a surface-mount chip component that contains at least two capacitors. The capacitance coupling element 10 is placed as close to the first edge line EL1 of the ground clearance region 20A as possible; the first edge line EL1 is aligned with the edge 20*e* of the above printed circuit board 20. That is, the distance D1 from the capacitance coupling element 10 to the first edge line EL1 is smaller than the distance D2 from the capacitance coupling element 10 to the fourth edge line EL4. If the capacitance coupling element 10 is placed adjacent to the edge 20*e* of the printed circuit board 20, about half of the space is an open space (free space) in which no substrate materials (conductor patterns) exist when seen from the capacitance coupling element 10. Therefore, it is possible to improve the efficiency of antenna radiation.

The capacitance coupling element 10 is provided at a position that is closer to the second edge line EL2 than a middle point in the longitudinal direction of the substantially-rectangular ground clearance region 20A. The distance D3 from the capacitance coupling element 10 to the second edge line EL2 is smaller than the distance D4 from the capacitance coupling element 10 to the third edge line EL3. As described later, this configuration is aimed at creating different lengths of the first and second strip patterns 21 and 22, thereby realizing a dual-band antenna having two antennas with different resonance frequencies.

In the ground clearance region 20A, the first to third strip patterns 21 to 23 are provided. One end of each of the first to third strip patterns 21 to 23 is connected to the capacitance coupling element 10. It is preferred that the first and second strip patterns 21 and 22 are linear and equal in width. It is preferred that the third strip pattern 23 is linear. The width of the third strip pattern 23 is preferably equal to that of the first and second strip patterns 21 and 22. However, the width of the third strip pattern 23 may vary when required.

One end of the first strip pattern 21 is connected to the capacitance coupling element 10; the other end of the first strip pattern 21 extends substantially straight toward the second edge line EL2 of the ground clearance region 20A from a connection point with the capacitance coupling element 10, and is connected to a first feeding line 29, which lies on the extension of the straight line. The first feeding line 29 is elongated from the second edge line EL2's side into the ground clearance region 20A. The other end of the first strip pattern 21 is connected to a first feeding point 33 via a first frequency adjustment element 31 and the first feeding line 29. Further, a first impedance adjustment element 35 is connected to the first feeding line 29 in parallel.

One end of the second strip pattern 22 is connected to the capacitance coupling element 10; the other end of the second strip pattern 22 extends substantially straight toward the third edge line EL3 of the ground clearance region 20A from a connection point with the capacitance coupling element 10, and is connected to a second feeding line 30, which lies on the extension of the straight line. The second feeding line 30 is elongated from the third edge line EL3's side into the ground clearance region 20A. The other end of the second strip pattern 22 is connected to a second feeding point 34 via a second frequency adjustment element 32 and the second feeding line 30. Further, a second impedance adjustment element 36 is connected to the second feeding line 30 in parallel.

In the present embodiment, the mounting position of the capacitance coupling element 10 as viewed from the edge 20*e* of the printed circuit board 20 is set back in such a way as to be closer to an inner part of the board than the positions of the first and second strip patterns 21 and 22. In other words, the first and second strip patterns 21 and 22 are disposed closer to the edge 20*e* of the printed circuit board 20 than the capacitance coupling element 10; the first and second strip patterns 21 and 22 are provided so as to extend parallel to the edge 20*e*. The capacitance coupling element 10 is preferably mounted as close to the edge 20*e* of the printed circuit board 20 as possible. However, given the accuracy of the mounting process, it is difficult to mount the capacitance coupling element 10 in the close vicinity of the edge 20*e*. Meanwhile, the degree of freedom and processing accuracy in the layout of conductor patterns are higher than those for surface-mount components. Therefore, the conductor patterns can be placed close to the edge 20*e* of the printed circuit board 20. In the present embodiment, the first and second strip patterns 21 and 22 and the capacitance coupling element 10 are not arranged in a line. The first and second strip patterns 21 and 22 are placed closer to the edge 20*e* than the capacitance coupling element 10. Therefore, it is possible to improve the radiation efficiency.

One end of the third strip pattern 23 is connected to the capacitance coupling element 10; the other end of the third strip pattern 23 extends straight toward the fourth edge line EL4 of the ground clearance region 20A from a connection point with the capacitance coupling element 10, and is connected to the ground pattern 24. The third strip pattern 23 is not necessarily linear, and may be a L-shaped pattern, for example. The third strip pattern 23 is preferably provided so as to extend in a direction perpendicular to the first and second strip patterns 21 and 22. All that is required is for the third strip pattern 23 to at least cross the first and second strip patterns 21 and 22.

In the ground clearance region 20A on the other principal surface of the printed circuit board 20, fourth and fifth strip patterns 25 and 26 are provided. The fourth strip pattern 25 is a lining pattern of the first strip pattern 21. The shape of the fourth strip pattern 25 is substantially identical to that of the first strip pattern 21. In planar view, the fourth strip pattern 25 overlaps with the first strip pattern 21. The fourth strip pattern 25 is connected to the first strip pattern 21 via a plurality of through-hole conductors 27, which pass through the printed circuit board 20. The fifth strip pattern 26 is a lining pattern of the second strip pattern 22. The shape of the fifth strip pattern 26 is substantially identical to that of the second strip pattern 22. In planar view, the fifth strip pattern 26 overlaps with the second strip pattern 22. The fifth strip pattern 26 is connected to the second strip pattern 22 via a plurality of through-hole conductors 28, which pass through the printed circuit board 20. This configuration further increases the apparent volumes of the first and second strip patterns 21 and 22 by making effective use of the ground clearance region 20A. Therefore, it is possible to increase the efficiency of antenna radiation.

As described above, the arrangement of the capacitance coupling element 10 in the ground clearance region 20A is offset toward the second edge line EL2. Accordingly, the length of the first strip pattern 21 is shorter than that of the second strip pattern 22. The first and second strip patterns 21 and 22, together with the third strip pattern 23 and the ground pattern 24 around the ground clearance region 20A, function as radiation electrodes of a dual-band antenna. Therefore, the resonance frequency of an antenna formed by the first strip pattern 21 is relatively high, and the resonance frequency of an antenna formed by the second strip pattern 22 is relatively low.

The current supplied from the first feeding line 29 flows through a loop surrounded by the first strip pattern 21, the third strip pattern 23, and the fourth edge line EL4 and second edge line EL2 of the ground pattern 24. As a result, electromagnetic waves by a high frequency-side antenna are emitted. The current supplied from the second feeding line 30 flows through a loop surrounded by the second strip pattern 22, the third strop pattern 23, and the fourth edge line EL4 and third edge line EL3 of the ground pattern 24. As a result, electromagnetic waves by a low frequency-side antenna are emitted. In either case, the bigger the loop becomes in size, the higher the radiation efficiency will be.

In the present embodiment, the third strip pattern 23 is shared by the first strip pattern 21, which makes up the high frequency-side antenna, and the second strip pattern 22, which makes up the low frequency-side antenna. For that purpose, the capacitance coupling element 10 is used. If different third strip patterns 23 are provided separately for the high frequency-side antenna and the low frequency-side antenna, and each pattern is formed as an independent L-shaped pattern antenna, and the capacitance coupling element 10 is omitted, current is widely distributed into the ground clearance region 20A, causing the current to flow into the board. As a result, the efficiency of the antennas tends to become lower. However, placing the capacitance coupling element at a connection point of the T-shaped pattern reduces the concentration of current within the around clearance region, resulting in an improvement in the efficiency of antenna radiation.

The following describes in detail the reasons why the conductor patterns on the printed circuit board 20 are used to form electromagnetic fields.

For example, in the case of a Bluetooth antenna, resonance frequency f is equal to 2.442 GHz (wavelength $\lambda$ in vacuum is equal to 122.77 mm), and required fractional bandwidth BW is 3.4%. If a substrate having the size of 2.00×1.25×1.00 mm is used to make a Bluetooth antenna whose antenna length La in the longitudinal direction of the substrate is 2 mm, wavelength ratio (a) of antenna length is: $a=2\pi La/\lambda=0.1023$. If radiation efficiency ($\eta$) is 0.5 ($\eta=0.5$; radiation efficiency 50%), Q-factor (Q) is: $Q=\eta(1+3a^2)/a^3(1+a^2)=476.8365$. Furthermore, if VSWR(S) is 2(S=2), bandwidth (BW) is calculated as: $BW=(s-1)\times 100/(\sqrt{s}\times Q)[\%]$. As a result, BW=0.1%. That is, if antenna length La=2, the above bandwidth, 3.4%, cannot be satisfied.

In that manner, in an ultra-small chip antenna whose antenna length La is smaller than $\lambda/2\pi$, it is theoretically impossible for a single capacitance coupling element to achieve more than the antenna characteristics obtained by the above formula. Therefore, in the case of the ultra-small chip antenna, it is very important to efficiently operate the antenna by making use of the current flowing through a conductor pattern on the printed circuit board 20.

Figure 3:
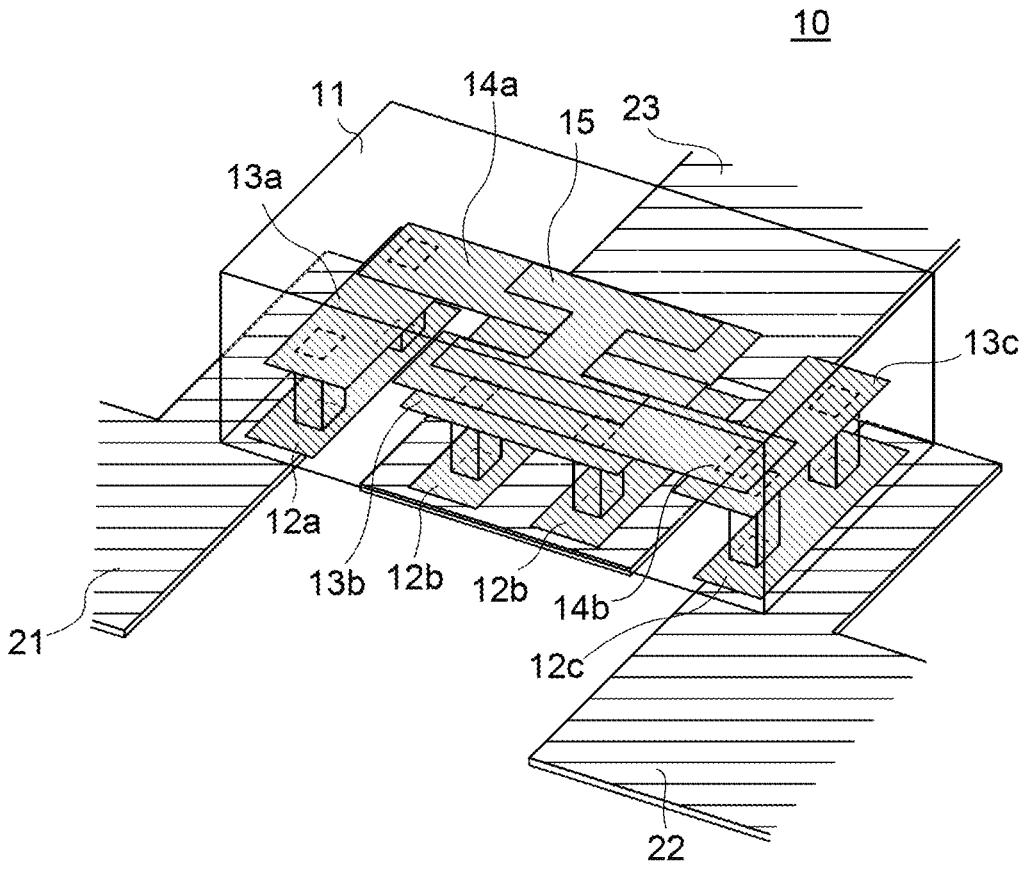
FIG. 3 is a schematic perspective view showing one example of the configuration of the capacitance coupling element 10, showing the capacitance coupling element 10 mounted on the printed circuit board 20.
Figure 4:
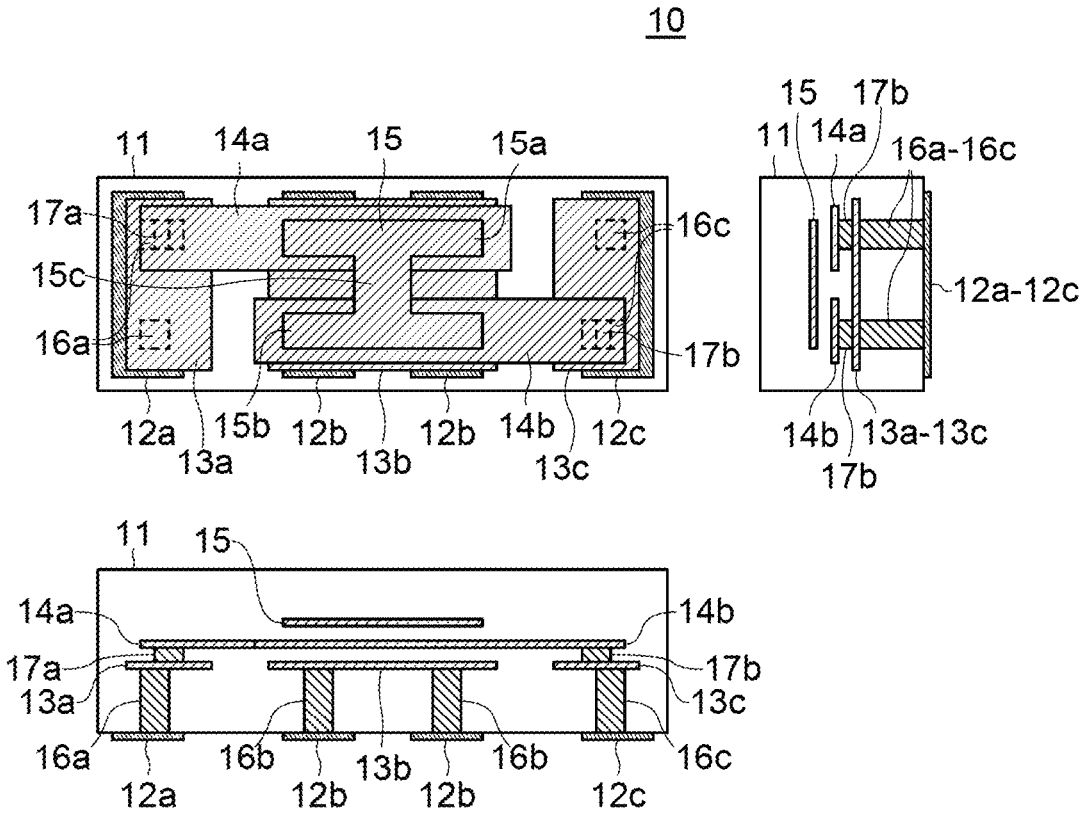
FIG. 4 is a three orthographic view of the capacitance coupling element 10 shown in FIG. 3.

FIG. 3 is a schematic perspective view showing one example of the configuration of the capacitance coupling element 10, showing the capacitance coupling element 10 mounted on the printed circuit board 20. FIG. 4 is a three orthographic view of the capacitance coupling element 10 shown in FIG. 3.

As shown in FIGS. 3 and 4, the capacitance coupling element 10 includes a substrate 11, which is a dielectric that is substantially in the shape of a rectangular parallelepiped; and a plurality of electrode layers (electrode patterns), which are formed inside the substrate 11. The substrate 11 is preferably a stack of a plurality of dielectric sheets. Incidentally, the up-down direction of the capacitance coupling element 10 is defined based on how the capacitance coupling element 10 is mounted on the printed circuit board 20. The bottom surface of the substrate 11 is a surface that comes in contact with the printed circuit board 20 when the substrate 11 is mounted.

Although the material of the substrate 11 is not specifically limited, it is particularly preferred that the substrate 11 be made of LTCC (Low Temperature Co-fired Ceramic). As for LTCC, low-temperature firing is possible at 1,000 degrees Celsius or less. Therefore, low-melting-point metal materials, such as Ag and Cu, which are low in electric resistance and excellent in high frequency characteristics, can be used as internal electrodes. Accordingly, an electrode pattern with a small resistance loss can be realized. Moreover, an electrode pattern can be formed in an inner layer of a multilayer structure. Therefore, a high-performance LC circuit can be made smaller in size. Another feature is that dielectric sheets that are different in relative permittivity can be stacked and simultaneously calcined. The permittivity of the substrate 11 needs to be set in such away that a built-in capacitor has a predetermined capacitance. The higher the permittivity of the substrate 11 becomes, the larger the capacitance will be.

On the bottom surface of the substrate 11, first to third terminal electrodes 12*a* to 12*c* are provided. The first and third terminal electrodes 12*a* and 12*c* are provided at both ends in the longitudinal direction of the bottom surface of the substrate 11; the first and third terminal electrodes 12*a* and 12*c* are so formed as to be in contact with the short sides of the bottom surface. The second terminal electrode 12*b* is provided between the first terminal electrode 12*a* and the third terminal electrode 12*c*. According to the present embodiment, the second terminal electrode 12*b* is divided into a plurality of electrodes. The planar layouts of the first to third terminal electrodes 12*a* to 12*c* have a line-symmetric relationship with respect to both the longitudinal direction and width direction of the bottom surface.

The electrode layers formed inside the substrate 11 include first to third plate electrodes 13*a* to 13*c*, which are located on the bottom inner layer (first layer) of the substrate 11; fourth and fifth plate electrodes 14*a* and 14*b*, which are located on an intermediate inner layer (second layer); and a sixth plate electrode 15, which is located on the top inner layer (third layer). It is preferred that those electrode layers be formed at substantially middle positions in the height direction of the substrate 11, and that dielectric layers provided on upper and lower layers thereof be thick to a certain extent. According to this configuration, the capacitances of capacitors inside the capacitance coupling element are less likely to be affected by the conductor patterns on the printed circuit board. Therefore, this configuration contributes to stabilizing the values of the capacitances.

The first plate electrode 13*a* is located above the first terminal electrode 12*a*, and is connected to the first terminal electrode 12*a* via a first via-hole conductor 16*a*. The second plate electrode 13*b* is located above the second terminal electrodes 12*b*, and is connected to the second terminal electrodes 12*b* via a plurality of second via-hole conductors 16*b*. The third plate electrode 13*c* is located above the third terminal electrode 12*c*, and is connected to the third terminal electrode 12*c* via a third via-hole conductor 16*c*.

The fourth plate electrode 14*a* is a strip pattern that extends from one end in the longitudinal direction of the substrate 11 to a central portion; one end portion of the fourth plate electrode 14*a* is connected to the first plate electrode 13*a* via a fourth via-hole conductor 17*a*, and the other end portion overlaps with the second plate electrode 13*b* in planar view. Therefore, the fourth plate electrode 14*a* and the second plate electrode 13*b*, or a pair of parallel plate electrodes, constitute a first capacitor C1.

The fifth plate electrode 14*b* is a strip pattern that extends from the other end in the longitudinal direction of the substrate 11 to the central portion; one end portion of the fifth plate electrode 14*b* is connected to the third plate electrode 13*c* via a fifth via-hole conductor 17*b*, and the other end portion overlaps with the second plate electrode 13*b* in planar view. Therefore, the fifth plate electrode 14*b* and the second plate electrode 13*b*, or a pair of parallel plate electrodes, constitute a second capacitor C2.

The planar shape of the sixth plate electrode 15 is H-shaped. The sixth plate electrode 15 includes a first electrode portion 15*a*, which is a line pattern parallel to the fourth plate electrode 14*a*; a second electrode portion 15*b*, which is a line pattern parallel to the fourth plate electrode 14*a*; and a third electrode portion 15*c*, through which longitudinal-direction central portions of the first and second electrode portions 15*a* and 15*b* are connected together. The other end portion of the fourth plate electrode 14*a* overlaps with the first electrode portion of the sixth plate electrode 15 in planar view. The other end portion of the fifth plate electrode 14*b* overlaps with the second electrode portion of the sixth plate electrode 15 in planar view. Accordingly, a capacitor C31 is formed between the fourth plate electrode 14*a* and the sixth plate electrode 15, and a capacitor C32 is formed between the fifth plate electrode 14*b* and the sixth plate electrode 15. As a result, a third capacitor C3 is formed: the third capacitor C3 is made up of the two capacitors C31 and C32 that are connected in series. That is, the fourth plate electrode 14*a* and the fifth plate electrode 14*b* constitute the third capacitor C3.

In the present embodiment, the third electrode portion 15*c* of the sixth plate electrode 15 is a thin line pattern that is perpendicular to the first and second electrode portions 15*a* and 15*b*. Therefore, the area of the third electrode portion 15*c* that overlaps with the bottom-layer second plate electrode 13*b* is very small. As a result, the stray capacitance that is generated between the sixth plate electrode 15 and the second plate electrode 13*b* is small, resulting in an improvement in antenna characteristics.

Figure 5:
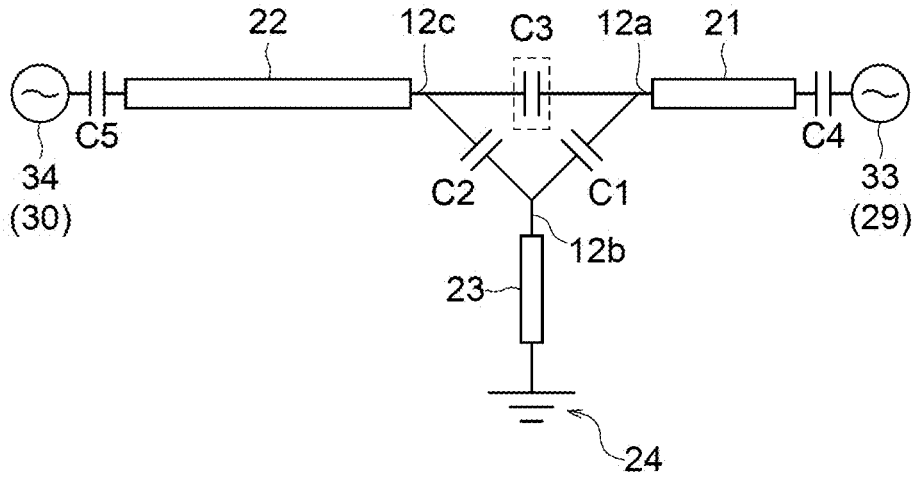
FIG. 5 is an equivalent circuit diagram of the antenna device 1.

FIG. 5 is an equivalent circuit diagram of the antenna device 1.

As shown in FIG. 5, in the antenna device 1, one end of each of the first, second, and third strip patterns 21, 22, and 23 is connected to each terminal of a circuit in which the three capacitors C1, C2, and C3 are delta-connected. One end of the first strip pattern 21 is connected to the first terminal electrode 12*a* of the capacitance coupling element 10, which is a connection point of the two capacitors C1 and C3. One end of the second strip pattern 22 is connected to the third terminal electrode 12*c* of the capacitance coupling element 10, which is a connection point of the two capacitors C2 and C3. One end of the third strip pattern 23 is connected to the second terminal electrode 12*b* of the capacitance coupling element 10, which is a connection point of the capacitors C2 and C1.

The other end of the first strip pattern 21 is connected to the first feeding point 33 (first feeding line 29) via a capacitor C4, which is the first frequency adjustment element 31. The other end of the second strip pattern 22 is connected to the second feeding point 34 (second feeding line 30) via a capacitor C5, which is the second frequency adjustment element 32. The other end of the third strip pattern 23 is grounded.

In the present embodiment, the first strip pattern 21, the capacitance coupling element 10, and the third strip pattern 23 work cooperatively with the ground pattern 24 around the ground clearance region 20A to operate as a high frequency-side antenna. The second strip pattern 22, the capacitance coupling element 10, and the third strip pattern 23 work cooperatively with the ground pattern 24 around the ground clearance region 20A to operate as a low frequency-side antenna. In this manner, a dual-band antenna can be realized. Furthermore, despite the fact that the two antennas, which have resonance frequencies that are close to each other, are disposed adjacent to each other in the ground clearance region 20A, it is possible to suppress the mutual interference between the two antennas and to ensure desired characteristics of each antenna. In that manner, a dual-band antenna that is small but good in isolation and which is high in radiation efficiency can be realized.

Figure 6:
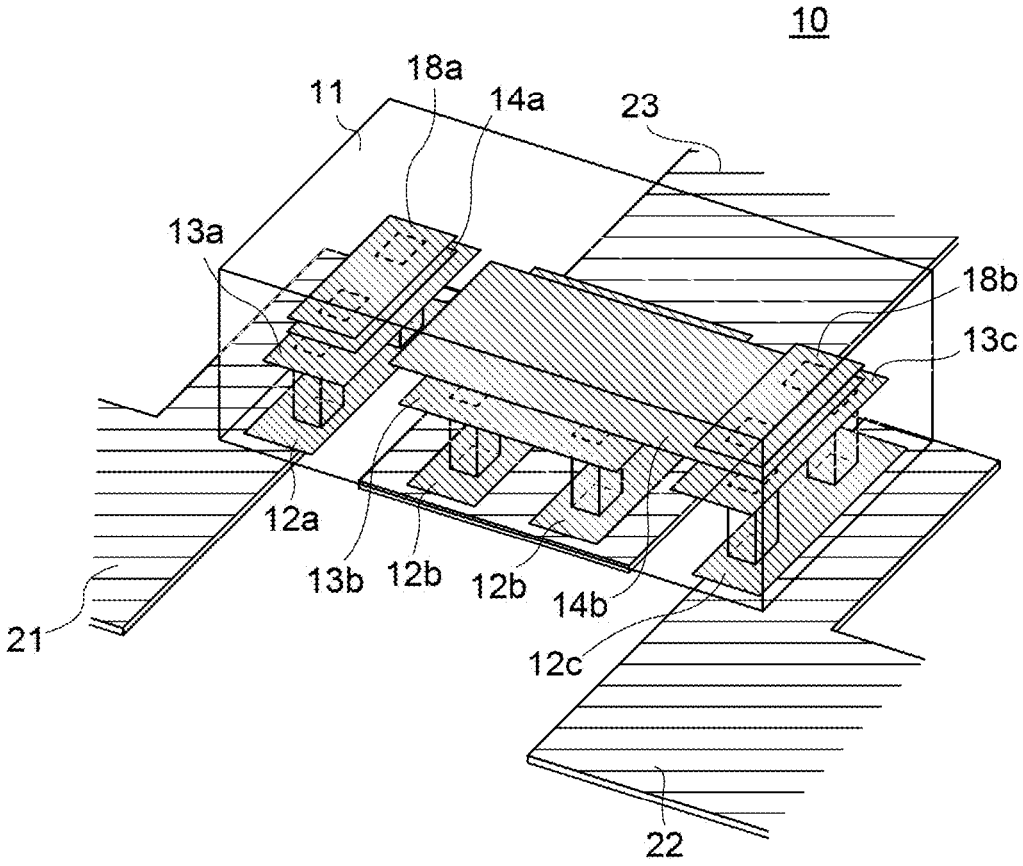
FIG. 6 is a schematic perspective view showing another example of the configuration of a capacitance coupling element 10, showing the capacitance coupling element 10 mounted on the printed circuit board 20.
Figure 7:
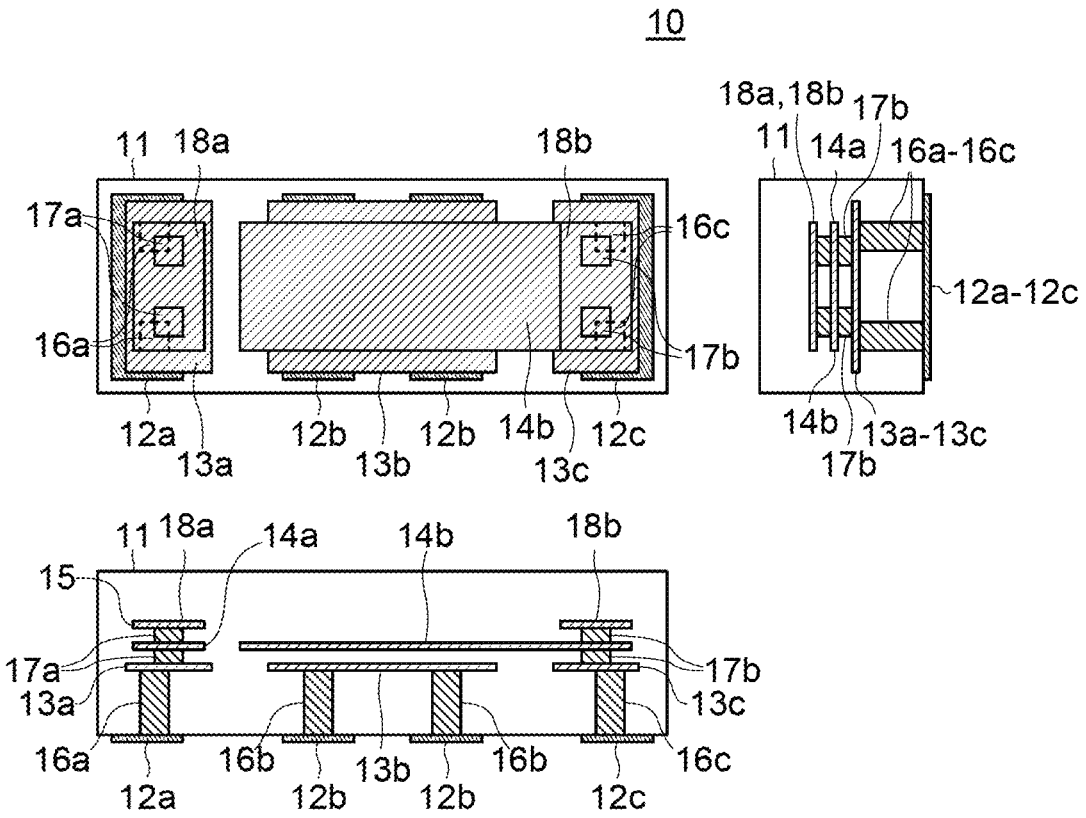
FIG. 7 is a three orthographic view of the capacitance coupling element 10 shown in FIG. 6.

FIG. 6 is a schematic perspective view showing another example of the configuration of a capacitance coupling element 10, showing the capacitance coupling element 10 mounted on the printed circuit board 20. FIG. 7 is a three orthographic view of the capacitance coupling element 10 shown in FIG. 6.

As shown in FIGS. 6 and 7, the capacitance coupling element 10 is characterized in that the capacitance of the capacitor C1 is far smaller than that of the capacitor C2, and the capacitor C3 is omitted. Accordingly, the fourth plate electrode 14*a* is not a strip pattern that extends from one end in the longitudinal direction of the substrate 11 to the central portion, and does not overlap with the second plate electrode 13*b* in planar view. As a result, the fourth plate electrode 14*a* and the second plate electrode 13*b* do not form a pair of parallel plate electrodes, and the capacitance of the first capacitor C1 is very small.

Meanwhile, the fifth plate electrode 14*b* is a strip pattern that extends from the other end in the longitudinal direction of the substrate 11 to the central portion, and is very wide in width. One end portion of the fifth plate electrode 14*b* is connected to the third plate electrode 13*c* via a fifth via-hole conductor 17*b*, and the other end portion overlaps with the second plate electrode 13*b* in planar view. The width of the fifth plate electrode 14*b* is greater than that shown in FIGS. 3 and 4. Therefore, the areas of the plate electrodes that overlap with each other are large, leading to an increase in the capacitance of the second capacitor C2.

Furthermore, in the present embodiment, there is no floating electrode (sixth plate electrode 15) overlapping with the fourth and fifth plate electrodes 14*a* and 14*b*. A seventh plate electrode 18*a* is just connected to the fourth plate electrode 14*a* via a fourth via-hole conductor 17*a*. An eighth plate electrode 18*b* is just connected to the fifth plate electrode 14*b* via the fifth via-hole conductor 17*b*. This means that there is no third capacitor C3.

For example, such a capacitance coupling element 10 is preferably used for the case where a multi-band antenna is so formed as to have two antennas having sufficiently-separated resonance frequencies (e.g., two times or more), like a low-frequency-side (2.45 GHz) antenna and a high-frequency-side (5.2 GHz) antenna for Wi-Fi. The reason is that, under such conditions, the smaller capacitance of the capacitor C1 is better for matching adjustment, and the capacitor C3 is not required. In that manner, in the antenna device 1 of the present invention, by appropriately setting the capacitances of the capacitors C1, C2, and C3 of the capacitance coupling element 10, the matching can be easily done in accordance with the resonance frequencies of the two antennas.

Figure 8:
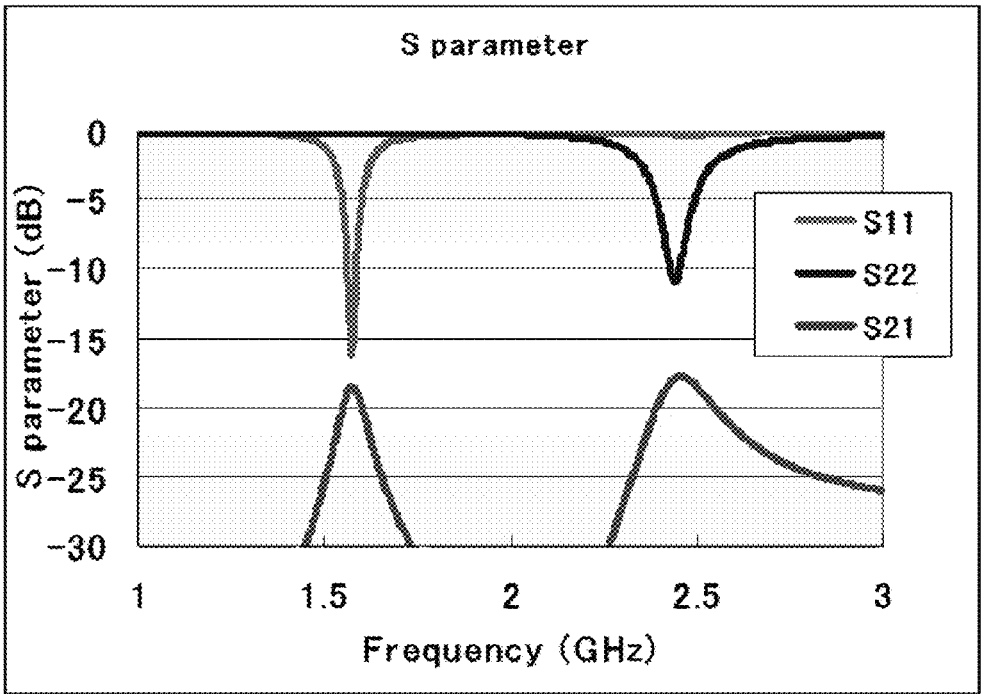
FIG. 8 is a graph showing S-parameter characteristics of the antenna device 1.

FIG. 8 is a graph showing S-parameter characteristics of the antenna device 1: the horizontal axis represents the frequency, and the vertical axis represents the value (dB) of S-parameter.

As indicated in FIG. 8, S11-characteristics (reflection loss) of the antenna device 1 has one peak by a minimum value of the gain (about −16 dB), when the frequency is about 1.57 GHz. S22-characteristics (reflection loss) has one peak by a minimum value of the gain (about −11 dB) when the frequency is about 2.45 GHz. S21-characteristics (insertion loss) of the antenna device 1 has two peaks by maximum values of the gain (about −18 dB) when the frequency is about 1.57 GHz or about 2.45 GHz. In this manner, as for S21-characteristics of the antenna device 1, the gain is less than or equal to −15 dB. This proves that the antenna device 1 is good in isolation.

Figure 9:
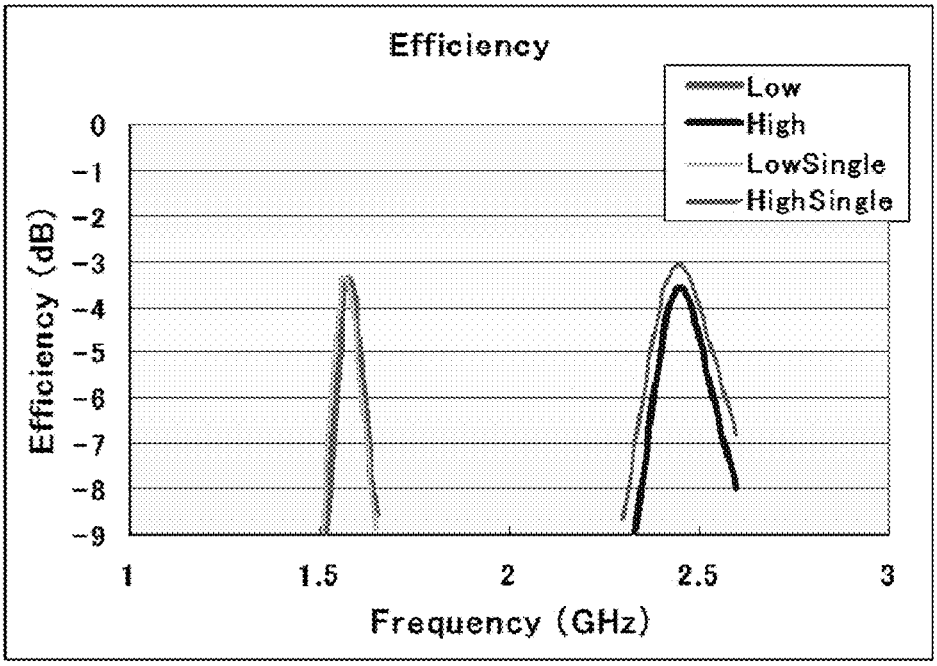
FIG. 9 is a graph on which the radiation efficiency of the antenna device 1 of the present embodiment is compared with that of a single-band antenna structure.

FIG. 9 is a graph on which the radiation efficiency of the antenna device 1 of the present embodiment is compared with that of a single-band antenna structure: the horizontal axis represents the frequency (GHz), and the vertical axis represents the gain (dB). In this case, as for the single-band antenna structure, the high frequency-side antenna made up of the first strip pattern 21 connected to the first feeding line 29, the capacitance coupling element 10, and the third strip pattern 23 is used as a first comparative example; the low frequency-side antenna made up of the second strip pattern 22 connected to the second feeding line 30, the capacitance coupling element 10, and the third strip pattern 23 is used as a second comparative example.

As shown in FIG. 9, the antenna device 1 of the present embodiment has a gain of −3.5 dB (bold line) when the frequency is about 1.57 GHz. Moreover, the antenna device 1 has a gain of −3.5 dB (bold line) when the frequency is about 2.45 GHz.

In Comparative Example 1, the high-frequency single band antenna has a gain of −3.5 dB even when the frequency is about 2.45 GHz (thin line). In Comparative Example 2, the low-frequency single band antenna has a gain of −3.5 dB when the frequency is about 1.57 GHz (thin line). That is, the radiation efficiency of the antenna device 1 of the present embodiment, which is a dual-band antenna, compares favorably with the single-band antenna structures, proving that the antenna device 1 is excellent in radiation efficiency.

Figure 10A:
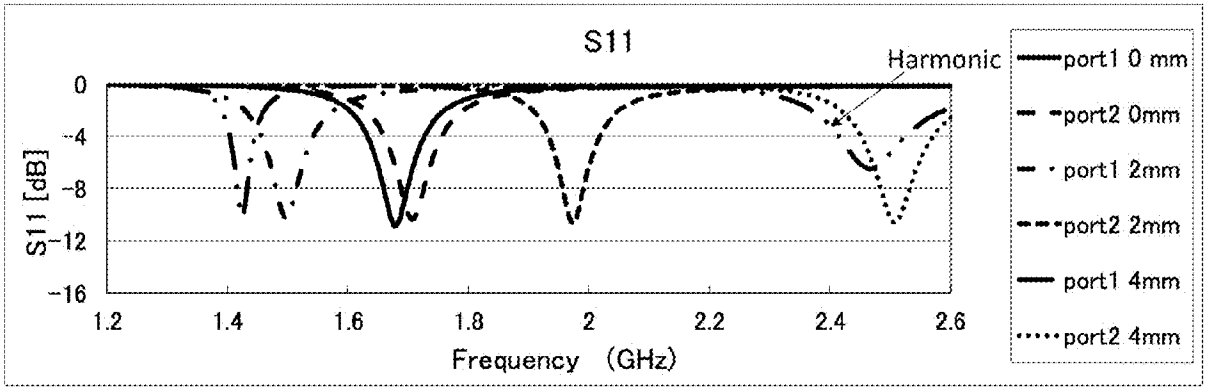
FIGS. 10A and 10B are graphs showing the characteristics of the antenna device 1 when the position where the capacitance coupling element 10 is mounted is moved in the longitudinal direction of the ground clearance region 20A.
Figure 10B:
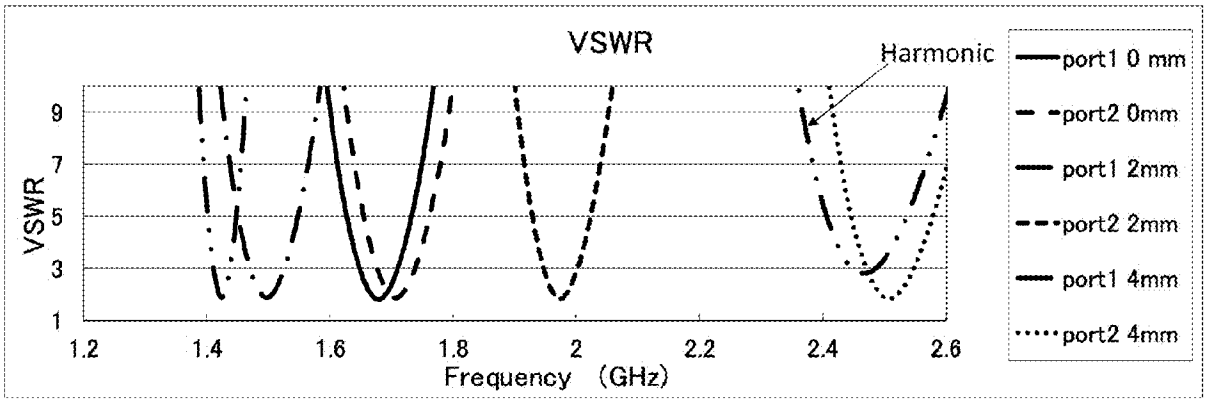
Figure 10C:
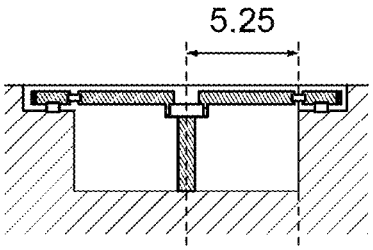
FIGS. 10C to 10E are plan views showing the antenna device 1 when the mounting position of the capacitance coupling element 10 is moved in the longitudinal direction of the ground clearance region 20A.
Figure 10D:
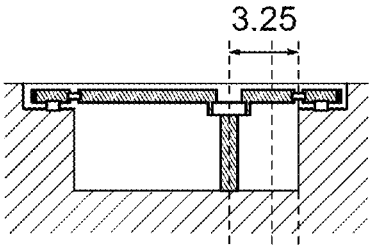
Figure 10E:
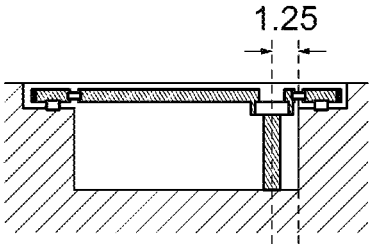

FIGS. 10A to 10E are graphs showing the characteristics of the antenna device 1 when the position where the capacitance coupling element 10 is mounted is moved in the longitudinal direction of the ground clearance region 20A. In particular, FIG. 10A is a graph showing S11-characteristics of S-parameter, and FIG. 10B is a graph showing VSWR characteristics. In this case, as for the position of the capacitance coupling element, a central portion in the longitudinal direction of the ground clearance region 20A is regarded as a reference position; the position of the capacitance coupling element is represented as an offset from the reference position. That is, the "0 mm", "2 mm", and "4 mm" in FIGS. 10A and 10B mean that the offsets of the capacitance coupling element are 0 mm, 2 mm, and 4 mm, respectively, as shown in FIGS. 10C, 10D, and 10E. As the mounting position of the capacitance coupling element 10 changes, the lengths of the first and second strip patterns 21 and 22 change. In FIG. 10C, the length of the first strip pattern 21 is equal to that of the second strip pattern 22. In FIG. 10D, the first strip pattern 21 is 4 mm shorter than the second strip pattern 22. In FIG. 10E, the first strip pattern 21 is 3 mm shorter than the second strip pattern 22.

As shown in FIGS. 10A and 10B, as for the S11-characteristics and VSWR characteristics of an antenna device (FIG. 10C) having a layout with an offset of 0 mm, there are peaks at 1.67 GHz and 1.69 GHz, meaning that the resonance frequencies of two antennas are substantially equal. This result stems from the fact that the lengths of the first and second strip patterns 21 and 22 are equal.

As for the S11-characteristics and VSWR characteristics of an antenna device (FIG. 10D) having a layout with an offset of 2 mm, there are peaks at 1.49 GHz and 1.96 GHz, meaning that the difference between the resonance frequencies of two antennas is large. The difference in the resonance frequencies is attributable to a difference in length between the first and second strip patterns 21 and 22.

As for the S11-characteristics and VSWR characteristics of an antenna device (FIG. 10E) having a layout with an offset of 4 mm, there are peaks at 1.42 GHz and 2.5 GHz, meaning that the difference between the resonance frequencies of two antennas is even larger. Incidentally, the peak at 2.47 GHz is a result of the emergence of a higher harmonic wave of a low frequency-side resonance frequency of 1.42 GHz. The difference in the resonance frequencies is attributable to a difference in length between the first and second strip patterns 21 and 22.

In that manner, in the antenna device 1 of the present embodiment, by adjusting the mounting position of the capacitance coupling element 10 and thereby adjusting the lengths of the first and second strip patterns 21 and 22, the resonance frequencies of the two antennas can be easily adjusted.

As described above, the antenna device 1 of the present embodiment can suppress the mutual interference even when two capacitance coupling elements having close resonance points are provided close to each other, and can avoid a deterioration of radiation characteristics of each capacitance coupling element. Consequently, a dual-band antenna that is small but good in isolation and which is high in radiation efficiency can be realized.

Although the preferable embodiment of the invention has been described above, it is needless to say that the invention is by no means restricted to the embodiment and can be embodied in various modes within the scope which does not depart from the gist of the invention.

For example, in the above embodiments, the configuration of the capacitance coupling element 10 shown in FIGS. 3 and 4, and the configuration of the capacitance coupling element 10 shown in FIGS. 6 and 7 have been described as examples. However, the configuration of the capacitance coupling element 10 is not specifically limited, and various other configurations may be employed. Moreover, the fourth and fifth strip patterns 25 and 26 are not necessarily required, and may be omitted.

What is claimed is:

1. An antenna device comprising:

a printed circuit board; and a capacitance coupling element mounted on the printed circuit board, wherein the capacitance coupling element includes:

a substrate that is made of dielectric material; and first and second capacitors that are provided in the substrate, the printed circuit board includes:

a ground clearance region that is defined on one principal surface of the printed circuit board, the capacitance coupling element being mounted on the ground clearance region;

a main circuit region that has a ground pattern;

first to third strip patterns that are provided in the ground clearance region; and first and second feeding lines that are elongated from the main circuit region to the ground clearance region, the first strip pattern has one end connected to one end terminal of the first capacitor of the capacitance coupling element and the other end connected to the first feeding line, the first strip pattern extending in a first direction from the one end thereof to the other end thereof, the second strip pattern has one end connected to one end terminal of the second capacitor of the capacitance coupling element and the other end connected to the second feeding line, the second strip pattern extending in a second direction, that is an opposite to the first direction, from the one end thereof to the other end thereof, the third strip pattern has one end connected to both the other end terminals of the first and second capacitors of the capacitance coupling element and the other end connected to the ground pattern, the third strip pattern extending in a third direction, that crosses the first and second directions, from the one end thereof to the other end thereof, the capacitance coupling element is disposed with an offset toward the first direction from a central portion of the ground clearance region in a direction parallel to the first and second directions, and the first strip pattern is shorter in length than the second strip pattern.

2. The antenna device as claimed in claim 1, wherein the ground clearance region has a substantially rectangular shape having first, second third and fourth edge lines, the first edge line is aligned with an edge of the printed circuit board, the second and third edge lines are substantially perpendicular to the first edge line and parallel to each other, the fourth edge line is parallel to the first edge line, the second and third edge lines are located in the first and second directions, respectively, as viewed from the capacitance coupling element, the first feeding line is elongated from the second edge line to the ground clearance region, and the second feeding line is elongated from the third edge line to the ground clearance region.

3. The antenna device as claimed in claim 2, wherein a distance between the capacitance coupling element and the first edge line is shorter than a distance between the capacitance coupling element and the fourth edge line, and a distance between the first and second strip patterns and the first edge line is shorter than a distance between the first and second strip patterns and the fourth edge line.

4. The antenna device as claimed in claim 1, wherein the other end of the first strip pattern is connected to the first feeding line via a first frequency adjustment element, and the other end of the second strip pattern is connected to the second feeding line via a second frequency adjustment element.

5. The antenna device as claimed in claim 1, wherein the capacitance coupling element further includes a third capacitor having one end terminal connected to the one end terminal of the first capacitor and the other end terminal connected to the one end terminal of the second capacitor.

6. The antenna device as claimed in claim 1, wherein the printed circuit board further includes fourth and fifth strip patterns that are provided on the other principal surface of the printed circuit board, the fourth strip pattern extends in the first direction and overlaps with the first strip pattern in planar view, the fifth strip pattern extends in the second direction and overlaps with the second strip pattern in planar view, the first strip pattern is connected to the fourth strip pattern via a first through-hole conductor that passes through the printed circuit board, and the second strip pattern is connected to the fifth strip pattern via a second through-hole conductor that passes through the printed circuit board.

7. A wireless communication device comprising:

an antenna device;

a wireless circuit section that is connected to the antenna device; and a communication control section that controls the wireless circuit section, wherein the antenna device includes:

a printed circuit board; and a capacitance coupling element mounted on the printed circuit board, the capacitance coupling element includes:

a substrate that is made of dielectric material; and first and second capacitors that are provided in the substrate, the printed circuit board includes:

a ground clearance region that is defined on one principal surface of the printed circuit board, the capacitance coupling element being mounted on the ground clearance region;

a main circuit region that has a ground pattern;

first to third strip patterns that are provided in the ground clearance region; and first and second feeding lines that are elongated from the main circuit region to the around clearance region, the first strip pattern has one end connected to one end terminal of the first capacitor of the capacitance coupling element and the other end connected to the first feeding line, the first strip pattern extending in a first direction from the one end thereof to the other end thereof, the second strip pattern has one end connected to one end terminal of the second capacitor of the capacitance coupling element and the other end connected to the second feeding line, the second strip pattern extending in a second direction, that is an opposite to the first direction, from the one end thereof to the other end thereof, the third strip pattern has one end connected to both the other end terminals of the first and second capacitors of the capacitance coupling element and the other end connected to the ground pattern, the third strip pattern extending in a third direction, that crosses the first and second directions, from the one end thereof to the other end thereof, the capacitance coupling element is disposed with an offset toward the first direction from a central portion of the ground clearance region in a direction parallel to the first and second directions, the first strip pattern is shorter in length than the second strip pattern, and the wireless circuit section and the communication control section are provided in the main circuit region of the printed circuit board.

* * * * *